United States Patent [19]

Carnaby

[11] 4,233,917

[45] Nov. 18, 1980

[54] NEEDLE STITCHING

[75] Inventor: Garth A. Carnaby, Papanui, New Zealand

[73] Assignee: Wool Research Organization of New Zealand (Inc.), Canterbury, New Zealand

[21] Appl. No.: 24,452

[22] Filed: Mar. 27, 1979

Related U.S. Application Data

[63] Continuation-in-part of Ser. No. 932,661, Aug. 10, 1978, abandoned.

[30] Foreign Application Priority Data

Aug. 10, 1977 [NZ] New Zealand ..... 184895

[51] Int. Cl.[3] ..... D05C 15/20

[52] U.S. Cl. ..... 112/222; 112/79 R

[58] Field of Search ..... 112/79 R, 79 A, 222, 112/223, 224, 227; 223/102

[56] References Cited

U.S. PATENT DOCUMENTS

| | | | |
|---|---|---|---|
| 738,567 | 9/1903 | Olsen | 112/224 |
| 1,323,340 | 12/1919 | Weis | 112/222 |
| 3,356,047 | 12/1967 | Short | 112/222 |
| 3,397,660 | 8/1968 | Luther | 112/222 |
| 3,403,647 | 10/1968 | Supitar | 112/222 |
| 3,469,548 | 9/1969 | Zocher | 112/222 |
| 3,645,222 | 2/1972 | Zocher | 112/224 |
| 3,929,082 | 12/1975 | Zocher | 112/222 |
| 3,954,072 | 5/1976 | Zocher | 112/222 |
| 4,128,067 | 12/1978 | Zocher | 112/222 |

*Primary Examiner*—Werner H. Schroeder
*Assistant Examiner*—Andrew M. Falik
*Attorney, Agent, or Firm*—Watson, Cole, Grindle & Watson

[57] ABSTRACT

A needle for tufting, sewing, stitching and the like machines, which needle comprises a suitably shaped elongate blade having at one end thereof a shank and at the other end thereof a point adjacent to which is positioned a needle eye which is shaped and dimensioned to allow unimpeded movement of yarn therethrough particularly when the needle is withdrawn in an upward direction with a loop of yarn held on a looper.

11 Claims, 8 Drawing Figures

NEEDLE STITCHING

FIELD OF THE INVENTION

This invention relates to needles of the type normally used on machines of the type commonly referred to as tufting machines, which needles can also be used on other machines such as sewing machines, stitching machines, stitch bonding machines and the like machines.

This application is a continuation-in-part of United States Patent Application Ser. No. 932,661 filed Aug. 10, 1978 now abandoned for Needles and/or Loopers.

DESCRIPTION OF THE PRIOR ART

In known tufting machines yarn is punched through a fabric by a needle through which a yarn is threaded. The yarn when through the fabric is caught and held by a looper positioned on the other side of the fabric which catches and holds the yarn while the needle is withdrawn.

The needles currently in use on such machines, for example, on a carpet tufting machine, often cause machine stoppages when yarn joints, knots, lumps, yarn irregularities, and impurities such as vegetable matter jam in the eye of the needle and break the yarn. Machine stoppages can also occur with regular or uniform yarns free from slubs, joints, knots or yarn irregularities if they have a low level of strength and/or extensibility. The needles currently in use do not give the minimum possible restriction of yarns, joints and lumps during the passage of the yarn through the needle eye nor do they give the minimum possible occurrence of unintentional cutting of the yarn at the looper as, for example, when a gross imperfection in the yarn increases tension therein as it passes through the needle eye. It is to be appreciated that similar problems occur with both staple and continuous filament yarns.

Accordingly it is an object of the present invention to provide a needle which overcomes at least in part the disadvantages stated above which are inherent in known needles.

Accordingly it is a further object of the present invention to provide a needle usable on tufting, sewing, stitching and the like machines, which needle comprises a suitably shaped elongate blade having at one end thereof a shank and at the other end thereof a point adjacent to which is positioned a needle eye which is shaped and dimensioned to allow unimpeded movement of yarn therethrough particularly when the needle is withdrawn in an upward direction with a loop of yarn held on a looper. This free flow of yarn is preferably achieved by providing a path for the yarn in the blade of the needle so that the yarn can flow through the needle eye with only minimal deflection from a straight line.

Further objects and advantages of the present invention will become apparent from the following description which is given by way of example only.

SUMMARY OF THE INVENTION

According to the present invention there is provided a needle for tufting, sewing, stitching and the like machines, which needle comprises a shaped elongate blade having at one end thereof a shank and at the other end thereof a point adjacent to which is positioned a needle eye, the elongate blade and the point having a path formed therein or thereon above the needle eye and on the point, which path allows unimpeded movement of yarn through the needle eye when the needle is withdrawn in an upward direction.

The path in the elongate blade and the point can be in the form of a channel or recess in the blade which constitutes a path for yarn toward the needle eye and the path in the point can be in the form of a cut-away portion on the side of the point opposite to the channel or recess.

The path is shaped so that the yarn is not unduly deflected from a straight line as it passes through the eye of the needle as can be seen from the accompanying drawings.

The preferred needles have a deflection angle as herein defined of less than 13 degrees.

Further aspects of the present invention which should be considered in all its novel aspects will become apparent from the following description which is given by way of example only.

BRIEF DESCRIPTION OF THE DRAWINGS

Examples of the present invention will now be described with reference to the accompanying drawings in which.

DESCRIPTION OF THE PREFERRED EMBODIMENTS

Examples of the present invention will now be described with reference to the use thereof on a carpet tufting machine on which cut, loop or cut/loop pile can be formed without imposing any limitation on the application of the invention to other machines or processes as described above.

Carpet tufting is a process in which yarns are stitched into a backing fabric on a carpet tufting machine.

Figure 1:
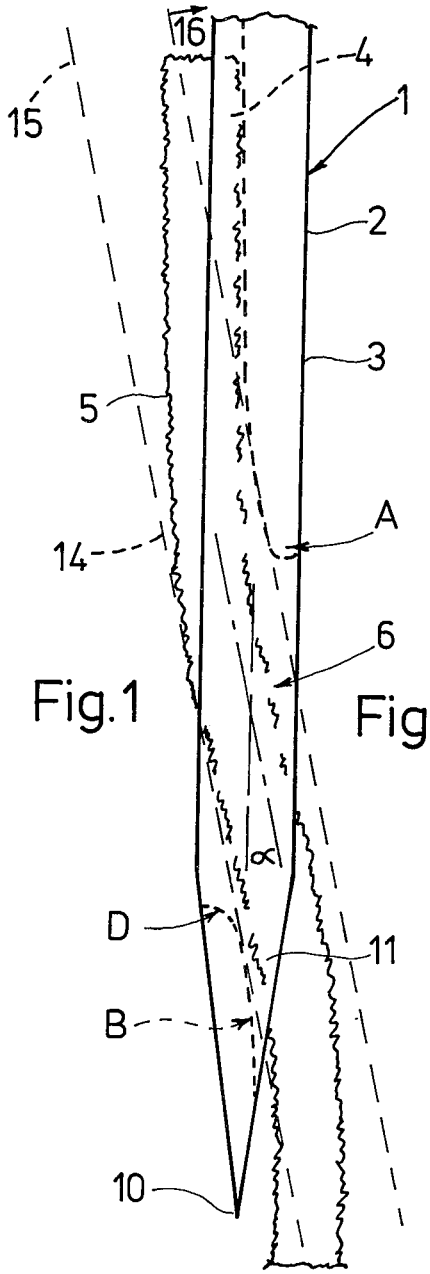
FIG. 1 is a side elevation of a needle according to the present invention.
Figure 2:
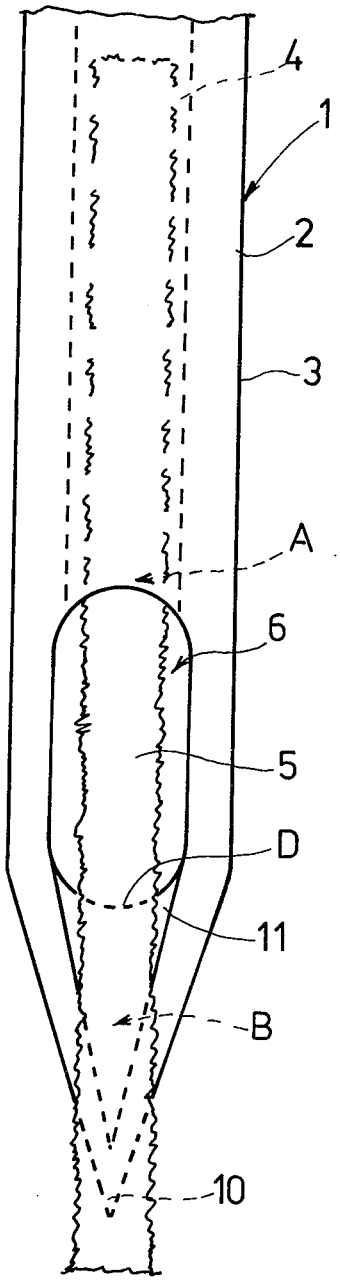
FIG. 2 is a front elevation of the needle shown in FIG. 1.

The needle shown in FIGS. 1 and 2 of the drawings is generally indicated by arrow 1 and has a shank portion 2 (the upper end of which is not shown) which is shaped so that it can be attached in known manner to a needle bar of a tufting machine to which a plurality of needles are incorporated.

The shank 2 is connected to an elongate blade 3 in which a channel or recess 4 (shown dotted) is formed which constitutes a path for yarn 5 toward a needle eye 6. The channel is shaped so that the yarn 5 is not unduly deflected from a straight line in the region of point A. In particular the channel 4 increases in depth to point A and at point A is deeper than at any other point along the length thereof.

The point region 10 of the needle blade 3 also has a part thereof removed thus reducing the thickness in cross section of the point 10 in the region of B. This reduced thickness part B is on the opposite side of the blade 3 to the channel or recess 4, and can be a cut-away portion 11 as shown. The shape of the cut-away portion 11 should be such as to give a minimum of cross sectional thickness of the needle at point B providing adequate mechanical strength and stability is retained.

A further aspect of special significance is the curved shape of the top of the cut-away portion 11 as indicated at point D. There must not be a sharp edge at D at the bottom of the needle eye 6 such as would catch lumps, joints and gross imperfections in the yarn.

Figure 3:
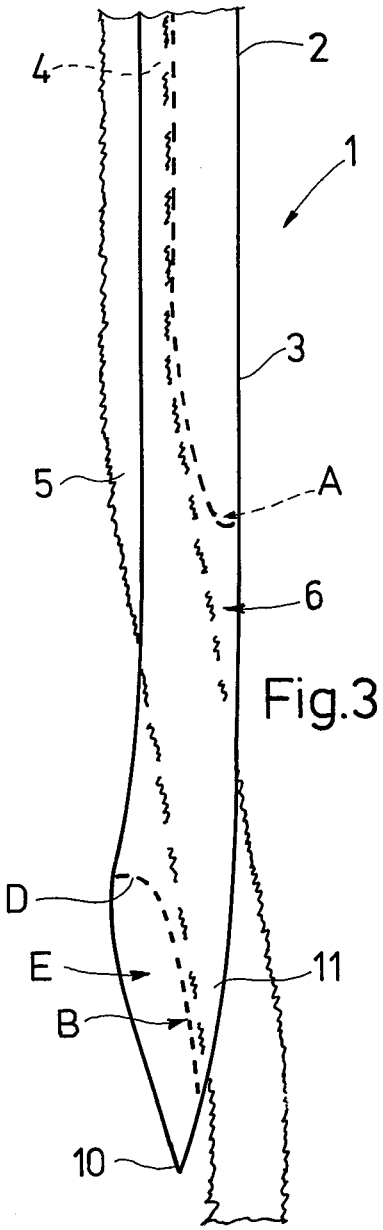
FIG. 3 is a side elevation of a further construction of needle according to the present invention.

The alternative construction of needle shown in FIG. 3 has the parts thereof referenced by the same numerals as the needle shown in FIG. 1. This construction of needle includes on the blade 3 of the needle 1 the provision of a slight lump E on the side of the needle point 10 which is opposite to the cut-away portion 11 to allow the channel to be made deeper in the side of the point and this avoids creating a sharp edge at D.

The recess or channel 4 in the blade 3 of the needle 1 forms together with the cut-away portion 11 a substantially unimpeded path so that movement of the yarn 5 through the needle eye 6 is substantially straight or with a minimum of deflection therein in the region of points A and B.

Figure 4:
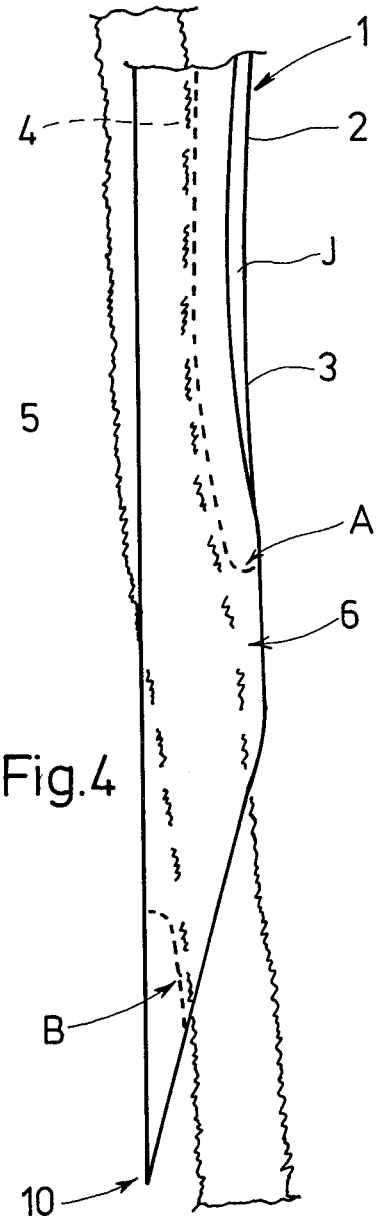
FIG. 4 is a side elevation of a further alternative construction of needle according to the present invention.
Figure 5:
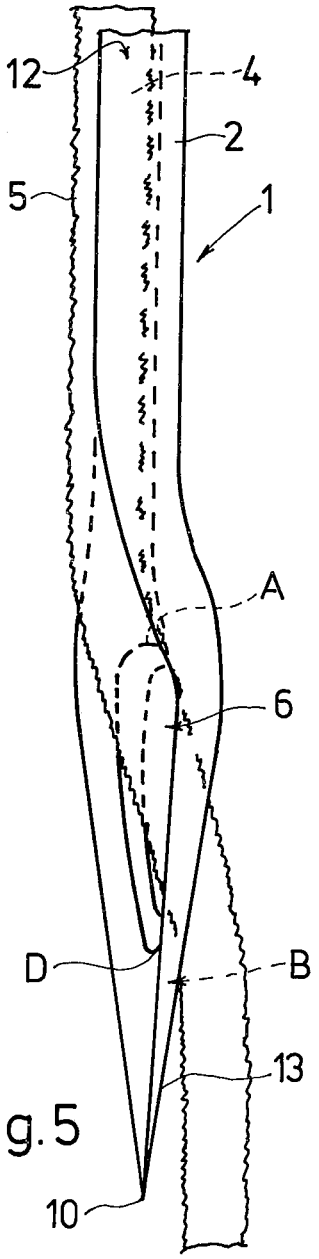
FIG. 5 is a side elevation of a further construction of needle according to the present invention.

The further alternative construction of needle shown in FIG. 4 also has the parts thereof referenced by the same numerals as the needle shown in FIG. 1. This construction of needle has the point 10 formed in an off-center location in order to provide a deeper channel in the region of B. This construction of needle is different to that found in known needles where the point is located off-center in that the off-center point of known needles has been in a plane perpendicular to that of the off-center point shown in FIG. 4.

A feature incorporated in most known needles is the cut-away region of the blade indicated by arrow J in FIG. 4. This feature is generally incorporated in needles according to the present invention, but is not shown in FIGS. 1 to 3.

The deflection that a yarn is likely to experience when passing through the needle as it is withdrawn in an upwards direction can be measured by placing a solid metal rod of known diameter through the eye of the needle and rotating it into alignment with the input and output grooves of the needle. This gives an indication of the possible deflection of a yarn passing through the eye of the needle. The angle of the axis of the rod relative to the axis of the needle (the deflection angle) will clearly depend on the diameter of the measuring rod and the length of the eye. The needles according to the present invention give little or no deflection in a rod (and hence a yarn) of infinitesimal thickness but for the purposes of measurement a rod has been selected as a measuring guide, the rod having a diameter exactly 0.3 times the maximum extent of the eye when it is viewed perpendicular to the axis of the needle. With such a rod the minimum deflection that can be achieved for various needles using the yarn grooves described hereinbefore are in the region of 0–13 degrees (a deflection angle of between 0–13degrees). None of the known prior art needles give deflections of the rod from the axis of the needle within this range and nearly all known needles and especially those used in commercial practice give deflections of between 20 and 30 degrees using this measuring guide.

The term "deflection angle" as used herein is defined as angle $\alpha$ (FIG. 1) between a measuring rod 14 having a diameter exactly 0.3 times the maximum lengthwise extent of needle eye 6 and the longitudinal axis of the needle.

An example of the manner in which this measuring guide is used is indicated in FIG. 1*a*. In FIG. 1 a rod 14 is shown placed so that the longitudinal axis thereof is aligned with the path through the input groove or channel 4 and the output groove or cut-away portion 11. The upper end 15 of the rod is pressed in the direction of arrows 16 so that the side edges of the rod 14 in the region of A and B contact the channel 4 and the cut-away portion 11. In this position the angle $\alpha$ between the axis of the needle and the longitudinal axis of the rod 14 is measured and constitutes the deflection angle.

It has been found during experiments that the provision of a channel above the eye of a needle which deepens just above the eye together with the provision of a groove of maximum depth below the eye leads to a lower failure rate of the yarn imperfections than has occurred with known constructions of needle.

This is especially true with known needles which have incorporated in the region of A a thread protection lump which in the present invention is removed when deepening the recess or channel 4. In the past such a thread protection lump has been incorporated to lessen the risk of the yarn being cut or broken as the needle moves downwards to be punched through a backing fabric. It has been photographic techniques that in the event of a yarn imperfection such as a joint or knot occurring the yarn does not need to move through the eye of a needle during the downward stroke thereof and accordingly such thread protection lumps are unnecessary. The yarn in fact need only pass through the eye of the needle during the upward stroke of the needle and the channel above the eye of the needle together with the groove below the eye leads to a lower failure rate of the yarn.

The sample of needle shown in FIGS. 5 to 8 shows a typical example of a further construction of needle, the parts of which are referenced by the same numerals as the needles described hereinbefore. In this needle 1 the recess 4 forms part of a known input groove 12 of the needle which is deepened just above the eye 6 in the region of A and to the deepened groove or cut-away portion 11 at point B on the output side 13 on the point region 10 of the needle.

The relative yarn failure rate for known needles and needles according to the present invention which give a minimum deflection of the yarn from a straight line can be determined by counting the failure rates for both types of needle when supplied with identical yarns containing known numbers of identical joints. In one experiment a number of known needles and a number of needles according to the present invention were supplied with the same yarns, each containing the same number of latex joints. The failure rate per thousand latex joints for various needles was as follows:

Needle 1: Eisbar 1249 BSW (rod deflection angle=38°), failures per 1000 latex joints=58.

Needle 2: Torrington T-19-1 (rod deflection angle=22.5°), failures per 1000 latex joints=54.

Needle 3: Singer 0636 (rod deflection angle=24°), failures per 1000 latex joints=85.

Needle 4: Needle according to the present invention with a rod deflection angle=9°, failures per 1000 latex joints=15 .

Figure 6:
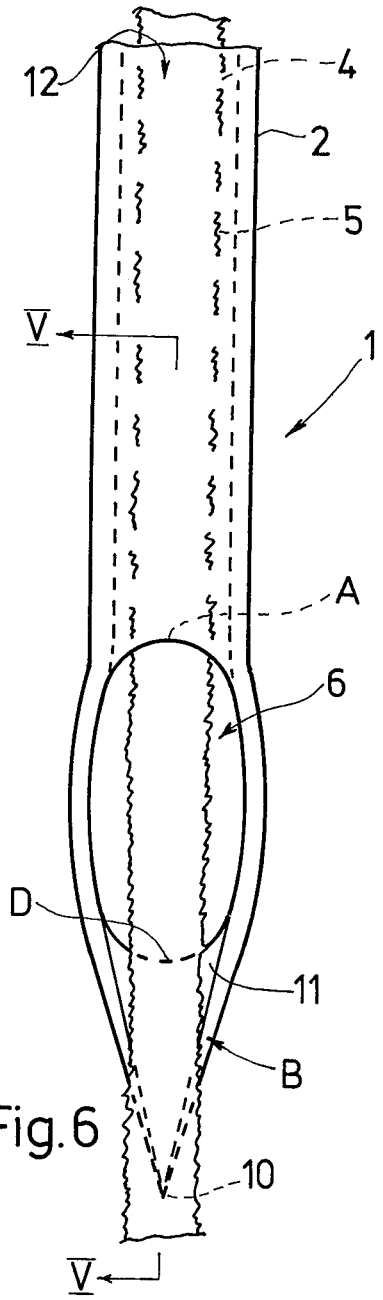
FIG. 6 is a front elevation of the needle shown in FIG. 5.
Figure 7:
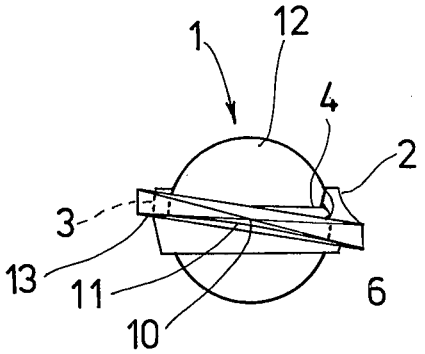
FIG. 7 is an end view of the needle shown in FIGS. 5 and 6.
Figure 8:
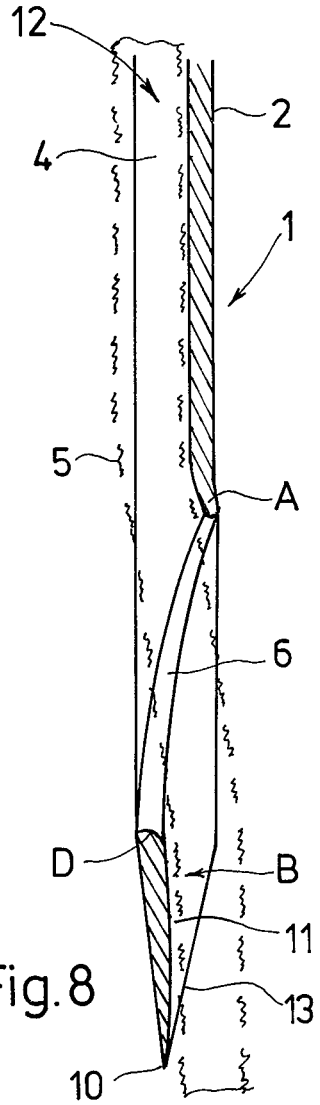
FIG. 8 is a cross section taken through the needle shown in FIG. 6 substantially along line 8—8.

It is to be appreciated that these improvements can be combined in a variety of different sized and shaped needles. Their effect is enhanced if the needle in the region of the eye is bulged adjacent to the eye to allow a wider eye as is shown in FIG. 6. The present invention can be combined with needles having various tip shapes, off-centre tips and twisted or biased tips as well as those shown in FIGS. 3 to 8.

The needles can also include other known features not shown in FIGS. 1 to 7, such as the cut-away region J shown in FIG. 4 which gives a cleaner action when a looper contacts the needle.

In use a plurality of the needles 1 according to one of the examples shown in FIGS. 1 to 8 and a plurality of loopers are incorporated into a carpet tufting machine.

The loopers can be any known loopers manufactured in known manner or alternatively can be loopers of the type described and claimed in the co-pending United States Application Ser. No. 932,661 entitled "Improvements in or relating to loopers".

The plurality of needles and loopers are incorporated into the carpet tufting machine so that in operation each needle 1 with the yarn 5 passing through the needle eye 6 thereof is punched through a backing fabric beneath which a corresponding looper catches and holds a loop of yarn as the needle is withdrawn. The shaped passage in the needle 1 as it is withdrawn upwards ensures free movement of the yarn 5 as it passes along the channel or recess 4 to the needle eye 6. As the yarn 5 is allowed to move so as to be deviated or unimpeded as little as possible as it passes through the needle eye 6 in the regions A and B of the needle 1 the yarn 5 runs more smoothly therethrough particularly when joints and lumps occur.

As a straighter flow of yarn occurs when the yarn 5 is caught and held by the looper when and if unintentional increases in tension occur the tendency of the looper to cut or break the yarn 5 is reduced.

Thus by the replacement of conventional needles with needles according to the present invention a substantial reduction in the breakage of yarns due to the jamming, sticking or breaking associated with imperfections and general yarn weakness therein is gained.

A corollary to this advantage is that the use of the needles according to the present invention enables a yarn of higher linear density to be tufted at a gauge other than is possible with known needles. This is because the larger joints and lumps associated with a thicker yarn are less difficult to pass through the eye of the needle according to the present invention.

Particular examples of the present invention have been described by way of example and it is envisaged that modifications to and variations of the present invention can take place without departing from the scope of the appended claims.

What I do claim and desire to obtain by Letters Patent of the United States of America is:

1. A needle for tufting, sewing, stitching and the like machines, the needle comprising a shaped elongate blade having at one end thereof a shank and at the other end thereof a point adjacent to which is positioned a needle eye, the elongate blade and the point having a shaped path formed therein above the needle eye and on the point, the path being defined by longitudinal recess located in one side of the blade above the eye and a cut-away portion on a side of a region of the point opposite said one side on which the longitudinal recess is located, the path allowing substantially unimpeded movement of yarn through the needle eye when the needle is withdrawn in an upward direction, the path being so shaped and dimensioned as to produce a deflection angle of not more than 13 degrees, said deflection angle being defined as an angle between the axis of a measuring rod having a diameter of exactly 0.3 times the maximum lengthwise extent of the needle eye and the longitudinal axis of the needle.

2. A needle as claimed in claim 1, wherein the path is shaped so that yarn is substantially undeflected from a straight line as the yarn passes through the eye of the needle.

3. A needle as claimed in claim 1, wherein the longitudinal recess is of a greater depth immediately above the eye of the needle as compared to the depth of the remainder of the recess.

4. A needle as claimed in claim 1, wherein the cut-away portion on the point reduces the thickness in cross-section of the point immediately below the needle eye.

5. A needle as claimed in claim 1, wherein the bottom of the needle eye lies at the top of the cut-away portion and is curvilinear.

6. A needle as claimed in claim 1, wherein the elongate blade has a slight lump on the side thereof opposite the cut-away portion to allow the cut-away portion to be made deeper in the side of the point.

7. A needle as claimed in claim 1, wherein the needle blade adjacent the region of the needle eye is transversely bulged to allow a wider eye to be formed therein.

8. A needle as claimed in claim 1, wherein the point thereof is off-center relative to the longitudinal axis of the needle.

9. A needle as claimed in claim 1, wherein the elongate blade and the point of the needle is twisted or biased.

10. A needle as clamed in claim 1, wherein one of the elongate blade and the point of the needle is twisted or biased.

11. A tufting, sewing, stitching and the like machine including a needle comprising a shaped elongate blade having at one end thereof a shank and at the other end thereof a point adjacent to which is positioned a needle eye, the elongate blade and the point having a shaped path formed therein above the needle eye and on the point, the path being defined by a longitudinal recess located in one side of the blade above the eye and cut-away portion on a side of a region of the point opposite said one side on which the longitudinal recess is located, the path allowing substantially unimpeded movement of yarn through the needle eye when the needle is withdrawn in an upward direction, the path being so shaped and dimensioned as to produce a deflection angle of not more than 13 degrees, said deflection angle being defined as an angle between the axis of a measuring rod having a diameter of exactly 0.3 times the maximum lengthwise extent of the needle eye and the longitudinal axis of the needle.

* * * * *